US008975830B2

(12) United States Patent
Sun et al.

(10) Patent No.: US 8,975,830 B2
(45) Date of Patent: Mar. 10, 2015

(54) LIGHT EMITTING SYSTEM, OPTICAL POWER CONTROL DEVICE, AND CONTROL SIGNAL MODULE

(71) Applicant: National Chi Nan University, Puli, Nantou (TW)

(72) Inventors: Tai-Ping Sun, Jhongli (TW); Hsiu-Li Shieh, Taichung (TW); Yung-Hsin Lu, Nantou (TW)

(73) Assignee: National Chi Nan University, Puli, Nantou (TW)

( * ) Notice: Subject to any disclaimer, the term of this patent is extended or adjusted under 35 U.S.C. 154(b) by 0 days.

(21) Appl. No.: 13/936,621

(22) Filed: Jul. 8, 2013

(65) Prior Publication Data

US 2014/0197756 A1 Jul. 17, 2014

(30) Foreign Application Priority Data

Jan. 17, 2013 (TW) ..... 102101806 A

(51) Int. Cl.
*H05B 37/02* (2006.01)
*H05B 33/08* (2006.01)

(52) U.S. Cl.
CPC ..... *H05B 33/0866* (2013.01); *H05B 33/0872* (2013.01)
USPC ..... 315/291; 315/308; 315/158; 315/387; 345/90; 345/39

(58) Field of Classification Search
CPC ..... H05B 33/0815; H05B 41/2855; H05B 39/0869; Y02B 20/202; G09G 1/04; G09G 3/3648
USPC ..... 315/291, 308, 158, 387; 345/90, 39
See application file for complete search history.

(56) References Cited

U.S. PATENT DOCUMENTS

| | | | | |
|---|---|---|---|---|
| 3,003,111 | A * | 10/1961 | Smith, Jr. | 327/134 |
| 7,990,077 | B2 * | 8/2011 | Yu et al. | 315/308 |
| 8,829,799 | B2 * | 9/2014 | Recker et al. | 315/160 |
| 8,830,702 | B2 * | 9/2014 | Macfarlane | 363/17 |
| 2007/0171146 | A1 * | 7/2007 | Lee et al. | 345/39 |
| 2008/0037303 | A1 * | 2/2008 | Mishimagi | 363/131 |
| 2008/0062105 | A1 * | 3/2008 | Han et al. | 345/90 |
| 2010/0148701 | A1 * | 6/2010 | Yu et al. | 315/309 |
| 2010/0315019 | A1 * | 12/2010 | Hoogzaad et al. | 315/291 |
| 2012/0019714 | A1 * | 1/2012 | Hiramatu et al. | 348/370 |
| 2012/0187863 | A1 * | 7/2012 | Nonaka et al. | 315/291 |
| 2013/0076260 | A1 * | 3/2013 | Sun et al. | 315/210 |
| 2013/0313985 | A1 * | 11/2013 | Choi et al. | 315/192 |
| 2014/0203716 | A1 * | 7/2014 | Tao | 315/186 |

* cited by examiner

*Primary Examiner* — Thuy Vinh Tran
*Assistant Examiner* — Syed M Kaiser
(74) *Attorney, Agent, or Firm* — Merchant & Gould P.C.

(57) ABSTRACT

A light emitting system includes a light emitting device having a forward voltage, and an optical power control device. The optical power control device includes a control signal module and a current controller. The control signal module generates a control signal according to the forward voltage, and the current controller permits flow of a driving current through the light emitting device according to the control signal.

12 Claims, 7 Drawing Sheets

LIGHT EMITTING SYSTEM, OPTICAL POWER CONTROL DEVICE, AND CONTROL SIGNAL MODULE

CROSS-REFERENCE TO RELATED APPLICATION

This application claims priority to Taiwanese Application No. 102101806, filed on Jan. 17, 2013.

BACKGROUND OF THE INVENTION

1. Field of the Invention

The invention relates to a light emitting system, an optical power control device, and a control signal module.

2. Description of the Related Art

FIG. 1 shows a conventional optical power control device adapted to receive a direct-current input voltage and generate a working current to drive a light-emitting diode (LED) 1. When the input voltage is constant, the working current has a constant magnitude.

However, the conventional optical power control device has the following drawbacks:

1. The working current resulting from the direct-current input voltage will increase temperature of the LED 1, and characteristics of the LED 1 will vary with temperature.

2. Referring to FIG. 2, a forward voltage of the LED 1 varies with ambient temperature, and LEDs 1 with different colors (e.g., blue, green and red) follow different forward voltage-temperature curves. When the LED 1 is driven with a constant current (e.g., 20 mA), rise of the ambient temperature may result in drop of the forward voltage, so that the output power of the LED 1 (=forward voltage×working current) drops with rise of the ambient temperature.

3. In application, several LEDs 1 with different colors are frequently used together to obtain light with a desired color temperature and a desired color rendering index. When each of the LEDs 1 with different colors is driven by a corresponding conventional optical power control device, the power ratio thereamong may drift due to different drop levels among the LEDs 1, such that the desired color temperature and the desired color rendering index may not be maintained.

SUMMARY OF THE INVENTION

Therefore, an object of the present invention is to provide a light emitting system that may have a relatively stable color temperature and a relatively stable color rendering index.

According to one aspect of the present invention, a light emitting system comprises:

a light emitting device that has a forward voltage with a magnitude dependent on an ambient parameter when driven with current; and an optical power control device including:

a control signal module including:

a reference voltage unit coupled to the light emitting device for detecting the forward voltage thereof, and outputting a reference voltage according to the forward voltage of the light emitting device; and a control signal generator coupled to the reference voltage unit for receiving the reference voltage, and operable to generate, according to the reference voltage, a control signal having a parameter associated with the reference voltage; and a current controller coupled to the light emitting device, and coupled to the control signal generator for receiving the control signal, the current controller being operable to permit flow of a driving current through the light emitting device, the driving current being associated with the parameter of the control signal.

Another object of the present invention is to provide an optical power control device that may alleviate output power drop of a light emitting device.

According to another aspect of the present invention, an optical power control device is adapted to control a light emitting device that has a forward voltage, and comprises:

a control signal module including:

a reference voltage unit to be coupled to the light emitting device for detecting the forward voltage thereof, and outputting a reference voltage according to the forward voltage of the light emitting device; and a control signal generator coupled to the reference voltage unit for receiving the reference voltage, and operable to generate, according to the reference voltage, a control signal having a parameter associated with the reference voltage; and a current controller to be coupled to the light emitting device, and coupled to the control signal generator for receiving the control signal, the current controller being operable to permit flow of a driving current through the light emitting device, the driving current being associated with the parameter of the control signal.

Yet another object of the present invention is to provide a control signal module used in the light emitting system of this invention.

According to yet another aspect of the present invention, a control signal module is adapted for use with a current controller to control flow of a driving current through a light emitting device that has a forward voltage, and comprises:

a reference voltage unit to be coupled to the light emitting device for detecting the forward voltage thereof, and outputting a reference voltage according to the forward voltage of the light emitting device; and a control signal generator coupled to the reference voltage unit for receiving the reference voltage, and operable to generate, according to the reference voltage, a control signal having a parameter associated with the reference voltage, the control signal to be provided to the current controller.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
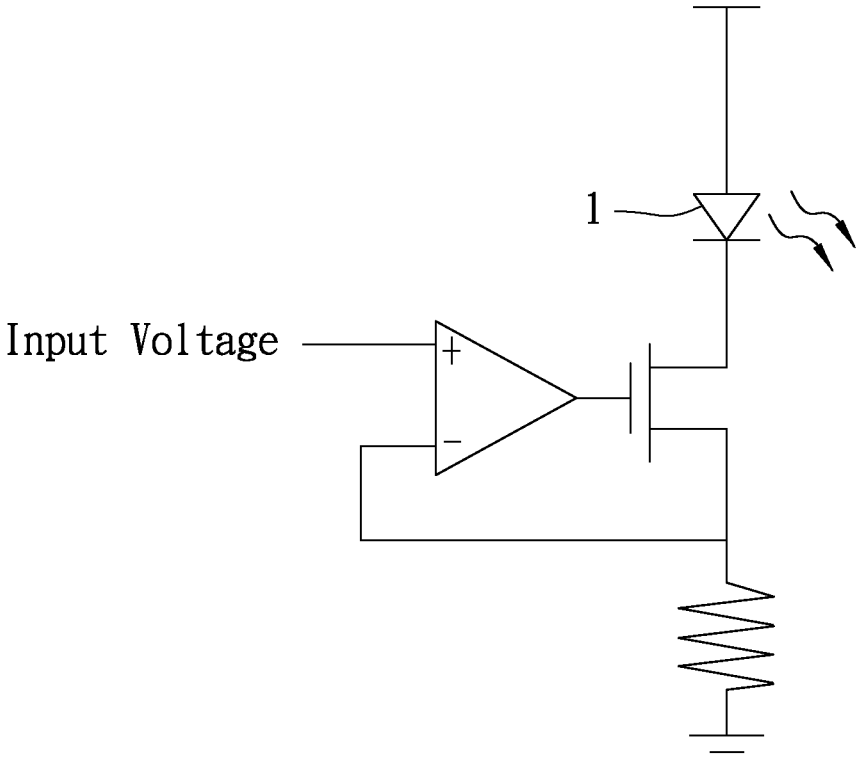
FIG. 1 PRIOR ART
FIG. 1 is a schematic circuit diagram of a conventional optical power control device.
Figure 2:
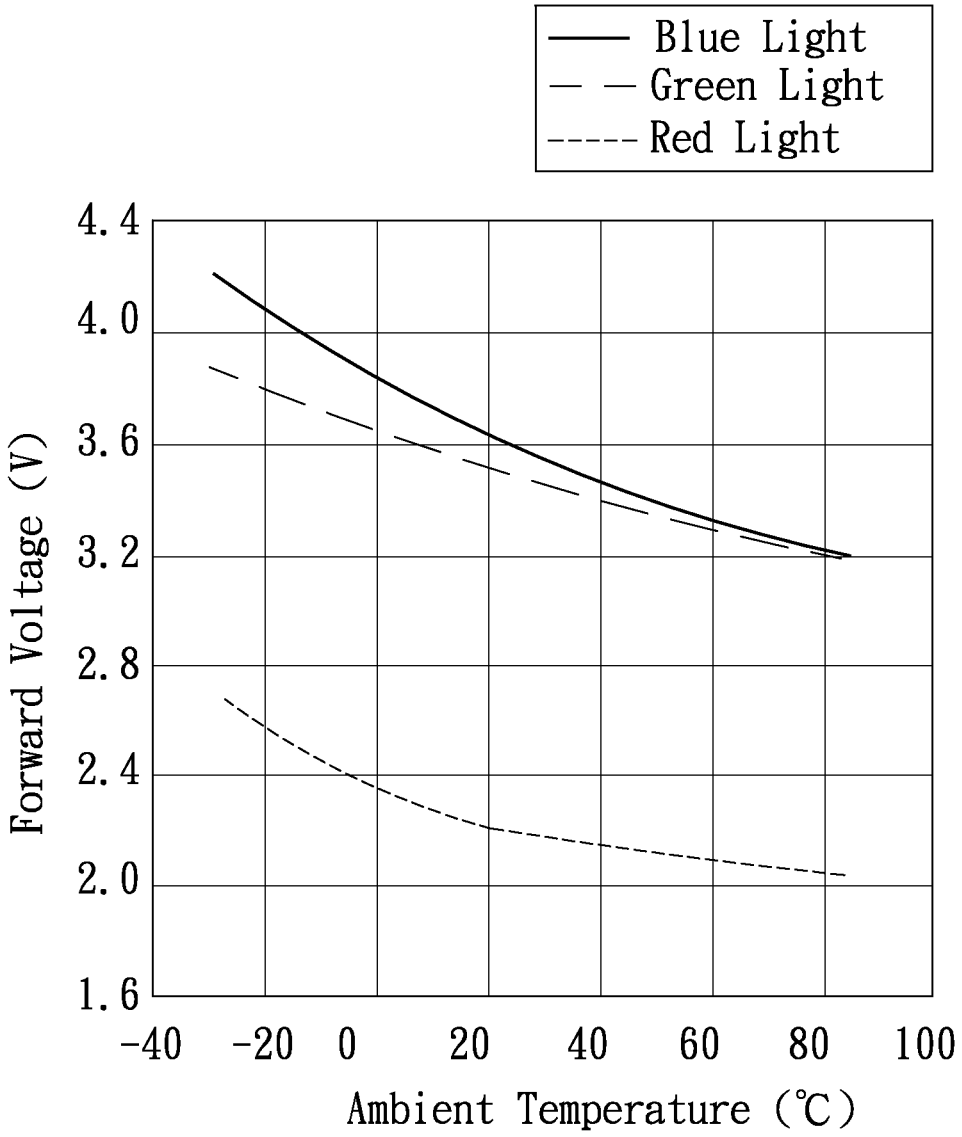
FIG. 2 PRIOR ART
FIG. 2 is a plot illustrating relationships between ambient temperature and forward voltages of light emitting diodes with different colors.
Figure 3:
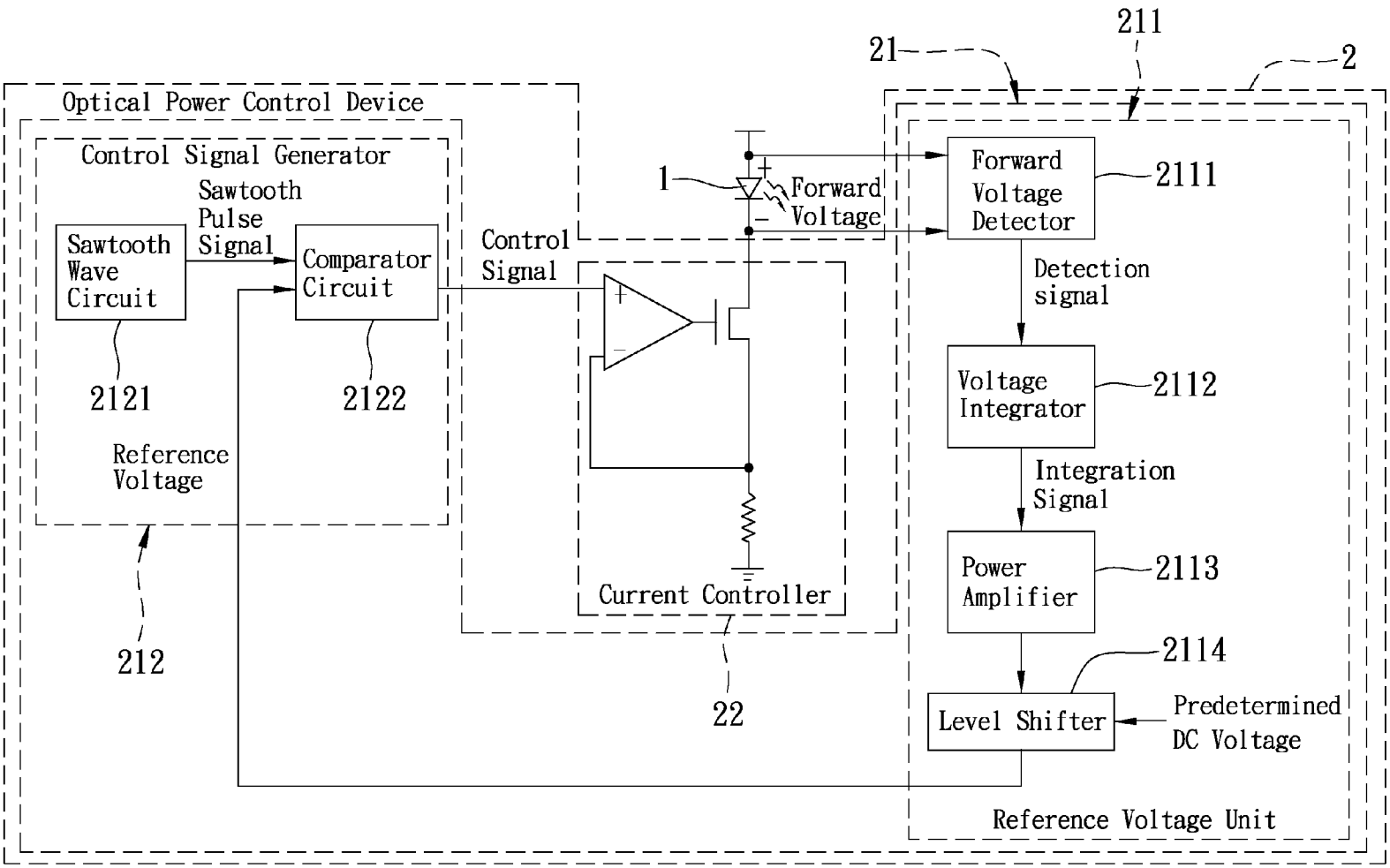
FIG. 3 is a block diagram of a preferred embodiment of a light emitting system according to the present invention.

Referring to FIG. 3, a preferred embodiment of the light emitting system according to the present invention is shown to include a light emitting device 1 and an optical power control device 2.

In this embodiment, the light emitting device 1 is a light emitting diode (LED) device that has a forward voltage with a magnitude dependent on an ambient parameter when driven with current. For the LED device in this embodiment, the ambient parameter is an ambient temperature.

The optical power control device 2 includes a control signal module 21 and a current controller 22.

The control signal module 21 includes a reference voltage unit 211 and a control signal generator 212.

The reference voltage unit 211 is coupled to the light emitting device 1 for detecting the forward voltage thereof, and outputs a reference voltage, which is a direct-current (DC) voltage, having a magnitude associated with an average magnitude of the forward voltage.

The reference voltage unit 211 includes a forward voltage detector 2111, a voltage integrator 2112, a power amplifier 2113 and a level shifter 2114.

Figure 4:
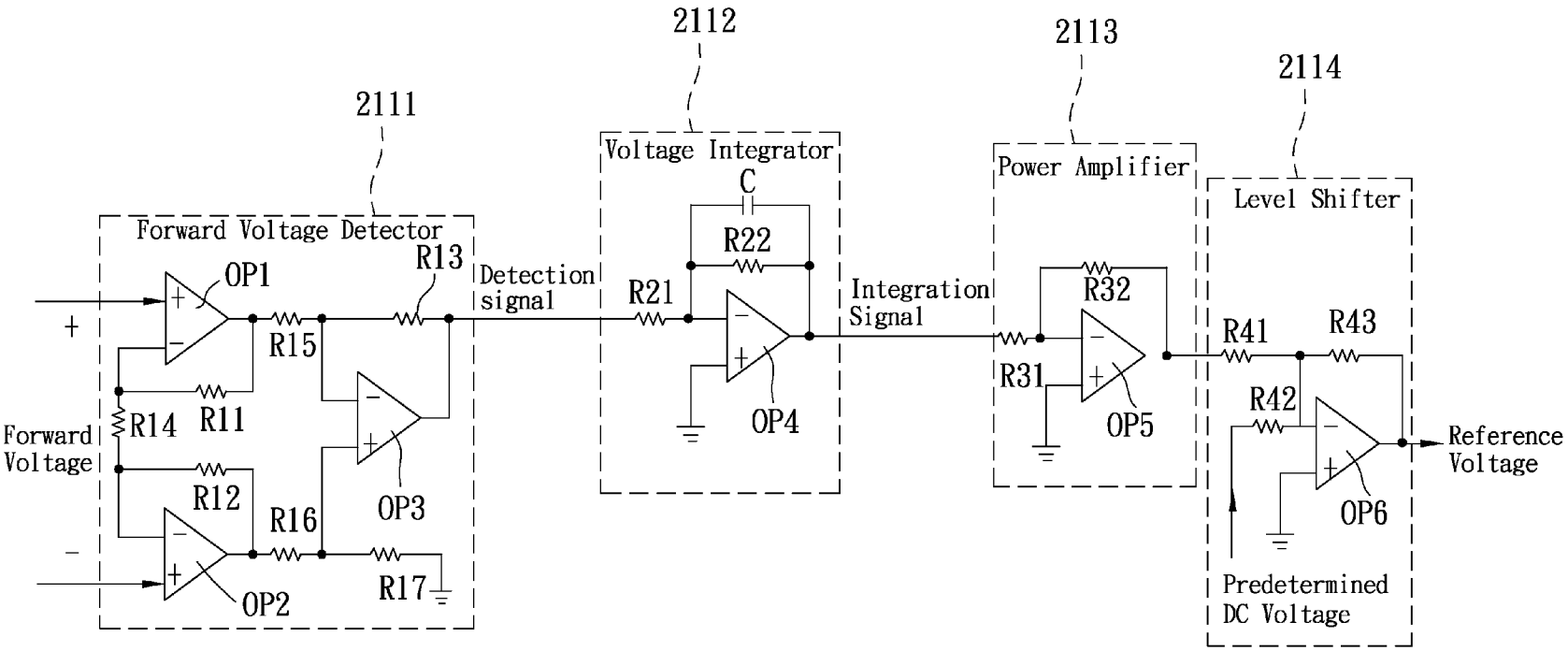
FIG. 4 is a schematic circuit diagram of a reference voltage unit of the preferred embodiment.

Referring to FIG. 4, the forward voltage detector 2111 is coupled to the light emitting device 1 (see FIG. 3) for detecting the forward voltage thereof, and outputs a detection signal that is a pulse voltage, and that has a magnitude varying with the magnitude of the forward voltage of the light emitting device 1.

The forward voltage detector 2111 includes first, second and third operational amplifiers OP1, OP2, OP3, and first to seventh resistors R11-R17. Each of the first, second and third operation amplifiers OP1, OP2, OP3 has a non-inverting input ("+"; first input), an inverting input ("−"; second input) and an output.

The first resistor R11 is coupled between the second input and the output of the first operational amplifier OP1. The second resistor R12 is coupled between the second input and the output of the second operational amplifier OP2. The third resistor R13 is coupled between the second input and the output of the third operational amplifier OP3. The fourth resistor R14 is coupled between the second inputs of the first and second operational amplifiers OP1, OP2. The fifth resistor R15 is coupled between the output of the first operational amplifier OP1 and the second input of the third operational amplifier OP3. The sixth resistor R16 is coupled between the output of the second operational amplifier OP2 and the first input of the third operational amplifier OP3. The seventh resistor R17 is coupled between the first input of the third operational amplifier OP3 and a ground node.

The first inputs of the first and second operational amplifiers OP1, OP2 are coupled to the light emitting device 1 for receiving the forward voltage thereof, and the output of the third operational amplifier OP3 outputs the detection signal.

The voltage integrator 2112 is coupled to the forward voltage detector 2111 for receiving the detection signal, and integrates the detection signal for generating an integration signal that is a direct-current (DC) voltage signal.

The voltage integrator 2112 includes an operational amplifier OP4, first and second resistors R21, R22, and a capacitor C.

The operational amplifier OP4 has a grounded non-inverting input ("+"; first input), an inverting input ("−"; second input) and an output. The first resistor R21 has a first terminal coupled to the forward voltage detector 2111 for receiving the detection signal, and a second terminal coupled to the second input of the operational amplifier OP4. The second resistor R22 is coupled between the second input and the output of the operational amplifier OP4. The capacitor C is coupled across the second resistor R22. The output of the operational amplifier OP4 outputs the integration signal.

The power amplifier 2113 is coupled to the voltage integrator 2112 for receiving the integration signal, and amplifies the integration signal for generating an amplified integration signal. Amplification of the power amplifier 2113 is designed with consideration of electro-optic conversion efficiency of the light emitting device 1. In detail, if the light emitting device 1 has greater reduction of the electro-optic conversion efficiency with rise of the ambient temperature, the amplification of the power amplifier 2113 is accordingly designed to be greater. Moreover, the amplification of the power amplifier 2113 is also determined according to a relationship between variation of the forward voltage of the light emitting device 1 and the ambient temperature.

The power amplifier 2113 includes an operational amplifier OP5, a first resistor R31 and a second resistor R32.

The operational amplifier OP5 has a grounded non-inverting input ("+"; first input), an inverting input ("−"; second input) and an output. The first resistor R31 has a first terminal coupled to the voltage integrator 2112 for receiving the integration signal, and a second terminal coupled to the second input of the operational amplifier OP5. The second resistor R32 is coupled between the second input and the output of the operational amplifier OP5. The output of the operational amplifier OP5 outputs the amplified integration signal.

The level shifter 2114 is coupled to the power amplifier 2113 for receiving the amplified integration signal, and shifts a voltage level of the amplified integration signal according to a predetermined DC voltage, so as to generate the reference voltage.

Figure 5:
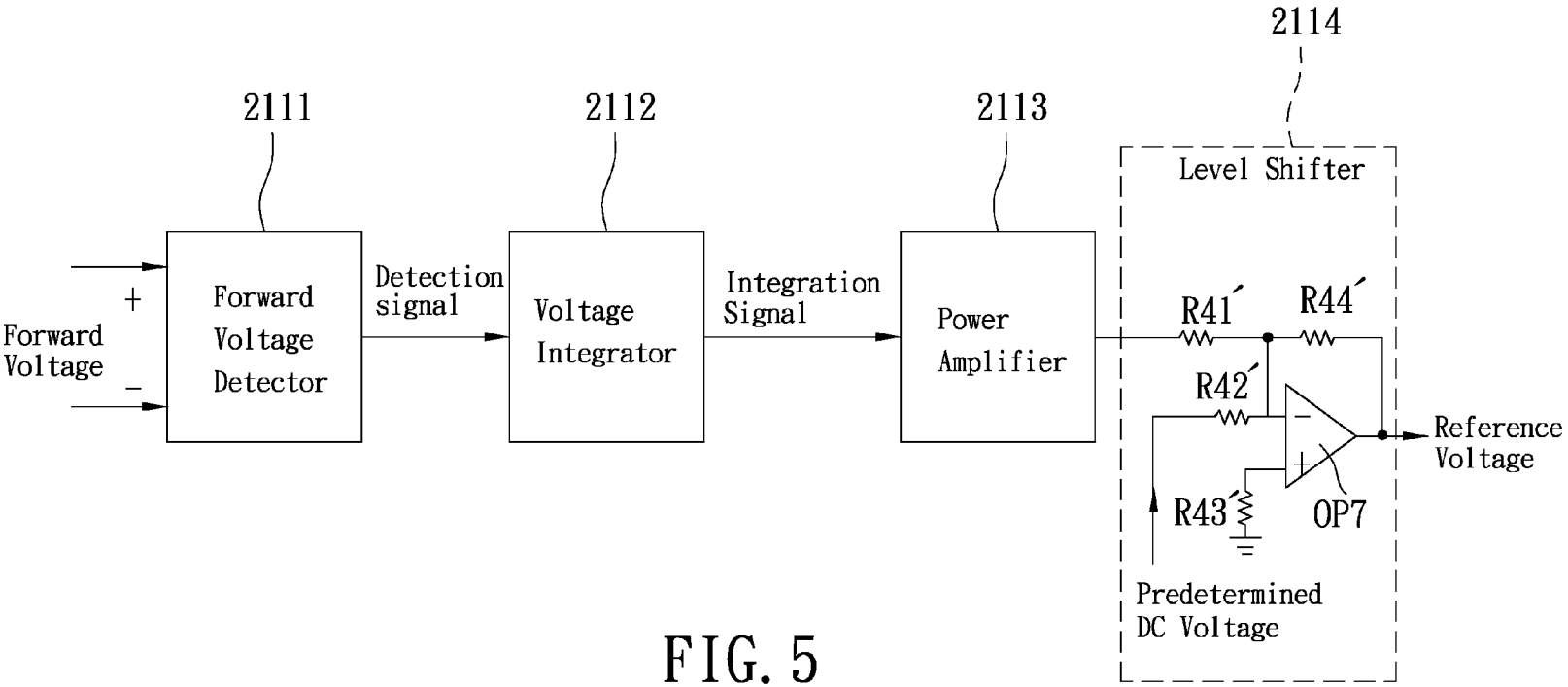
FIG. 5 is a schematic circuit diagram to illustrate another implementation of a level shifter of the reference voltage unit of the preferred embodiment.

In one embodiment, the level shifter 2114 may be a voltage adder which adds the predetermined DC voltage to the amplified integration voltage to generate the reference voltage, as shown in FIG. 4. In another embodiment, the level shifter 2114 is a voltage subtractor which subtracts the predetermined DC voltage from the amplified integration voltage to generate the reference voltage, as shown in FIG. 5. The predetermined DC voltage has a voltage level determined according to a relationship between variation of the forward voltage of the light emitting device 1 and the ambient temperature.

Referring to FIG. 4, the level shifter 2114, which is a voltage adder, includes an operational amplifier OP6, and first, second and third resistors R41, R42, R43.

The operational amplifier OP6 has a grounded non-inverting input ("+"; first input), an inverting input ("−"; second input) and an output. The first resistor R41 has a first terminal coupled to the power amplifier 2113 for receiving the amplifier integration signal, and a second terminal coupled to the second input of the operational amplifier OP6. The second resistor R42 has a first terminal disposed to receive the predetermined DC voltage, and a second terminal coupled to the second input of the operational amplifier OP6. The third resistor R43 is coupled between the second input and the output of the operational amplifier OP6. The output of the operational amplifier OP6 outputs the reference voltage.

Referring to FIG. 5, the level shifter 2114, which is a voltage subtractor, includes an operational amplifier OP7, and first, second, third and fourth resistors R41', R42', R43' and R44'.

The operational amplifier OP7 has a non-inverting input ("+"; first input), an inverting input ("−"; second input) and an output. The first resistor R41' has a first terminal coupled to the power amplifier 2113 for receiving the amplifier integration signal, and a second terminal coupled to the second input of the operational amplifier OP7. The second resistor R42' has a first terminal disposed to receive the predetermined DC voltage, and a second terminal coupled to the first input of the operational amplifier OP7. The third resistor R43' is coupled between the ground node and the first input of the operational amplifier OP7. The fourth resistor R44' is coupled between the second input and the output of the operation amplifier OP7. The output of the operational amplifier OP7 outputs the reference voltage.

Figure 6:
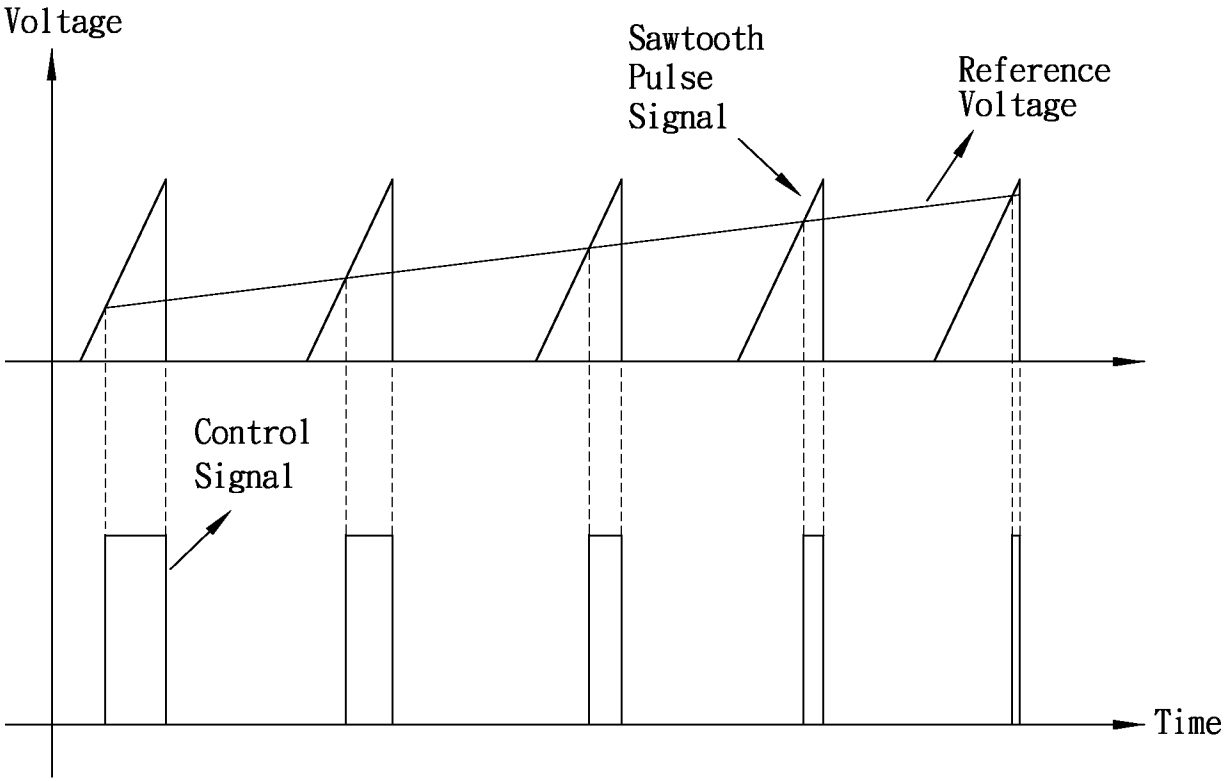
FIG. 6 is a plot illustrating generation of a control signal by a control signal generator of the preferred embodiment.

Referring to FIGS. 3 and 6, the control signal generator 212 is coupled to the reference voltage unit 211 for receiving the reference voltage, and generates, according to the reference voltage, a control signal having a parameter associated with the reference voltage. In this embodiment, the control signal is a pulse signal, and the parameter of the control signal is a duty cycle of the pulse signal, which is associated with the magnitude of the reference voltage.

The control signal generator 212 includes a sawtooth wave circuit 2121 and a comparator circuit 2122.

The sawtooth wave circuit 2121 is adapted for generating a sawtooth pulse signal. The comparator circuit 2122 is coupled to the sawtooth wave circuit 2121 for receiving the sawtooth pulse signal, and is coupled to the reference voltage unit 211 for receiving the reference voltage. The comparator circuit 2122 generates the control signal according to comparison of the reference voltage and the sawtooth pulse signal, such that the duty cycle of the control signal has an inverse relation to a magnitude of the reference voltage.

The current controller 22 is coupled to the light emitting device 1, and is coupled to the control signal generator 2 for receiving the control signal that is a pulse signal. The current controller 22 permits flow of a driving current through the light emitting device 1. The driving current is thus a pulse current that has an average magnitude proportional to the duty cycle of the control signal.

In this embodiment, when rise of the ambient temperature results in drop of the forward voltage of the light emitting device 1, the magnitude of the reference voltage outputted by the optical power control device 2 will become smaller, causing an increase in the duty cycle of the control signal. The increased duty cycle of the control signal makes the average magnitude of the driving current larger, thereby promoting the optical power and brightness of the light emitting device 1. The brightness of the light emitting device 1 is thus substantially non-varying with the ambient temperature via detection and feedback features of the control signal module 21 of the preferred embodiment. It should be noted that, with rise of the ambient temperature, although reduction of the forward voltage is associated with reduction of the optical power of the light emitting device 1, there are differences existing therebetween. If the forward voltage is directly used as the reference voltage (i.e., amplification is 1, and the predetermined DC voltage is 0) for adjusting the duty cycle of the control signal, although the electric power (product of the forward voltage and the driving current) of the light emitting device 1 may be non-varying with the ambient temperature, the optical power (measured by instrument) thereof may still vary with the ambient temperature due to lack of consideration of the electro-optic conversion characteristic. In detail, the electrical power $P=I\times V$, and the optical power $L=P\times N(t)$, where I is the driving current flowing through the light emitting device 1, V is the forward voltage of the light emitting device 1, and N(t) is the electro-optic conversion efficiency of the light emitting device 1. It is known from the equations that even if the electrical power P is non-varying with the ambient temperature, the optical power L may vary with the ambient temperature since the electro-optic conversion efficiency varies with the ambient temperature t. Generally, N(t) is reduced with rise of the ambient temperature. Accordingly, sensitivity of the duty cycle versus ambient temperature may be set via adjustment of the amplification of the power amplifier 2113, so as to compensate the temperature effect resulting from the electro-optic conversion efficiency N (t), and to make the optical power L non-varying with the ambient temperature.

In practice, if the light emitting device 1 has greater reduction of the electro-optic conversion efficiency with rise of the ambient temperature, the amplification of the power amplifier 2113 is accordingly designed to be greater, so as to make the optical power L non-varying with the ambient temperature.

Furthermore, if the dynamic range of the duty cycle is required to be larger versus the same temperature range (i.e., more sensitive), the amplification of the power amplifier 2113 may be designed to be larger. In the following example, it is assumed that temperature variation from 40° C. to 80° C. results in 0.1V variation of the reference voltage when the amplification of the power amplifier 2113 is 1, and the duty cycle of the control signal correspondingly rises by 2%, which is insufficient to effectively promote the optical power of the light emitting device 1. However, when the amplification is designed to be 5, the same temperature variation will result in 0.5V variation (five times 0.1V) of the reference voltage, resulting in 10% (=2%×5) increment of the duty cycle of the control signal, which is five times the original increment, so as to effectively promote the optical power of the light emitting device 1.

Since human eyes have different sensitivities to lights with different wave lengths (colors), the preferred embodiment uses the lever shifter 2114 to shift the voltage level of the amplified integration signal according to the color of the light emitting device 1, so as to optimize the optical power of the light emitting device 1. Furthermore, the level shifter 2114 may be used to inversely offset a dynamic range of the duty cycle of the control signal. For example, when the light emitting device 1 is required to have a greater brightness, the level shifter 2114 maybe used to add a relatively smaller voltage to, or to subtract a voltage from the amplifier integration signal, to thereby result in a relatively higher dynamic range of the duty cycle of the control signal, such as 50%~80%, having a dynamic range of 30%. When the light emitting device 1 is required to have a smaller brightness, the level shifter 2114 may be used to add a relatively greater voltage to the amplifier integration signal, to thereby result in a relatively lower dynamic range of the duty cycle of the control signal, such as 40%~70%, having a dynamic range of 30%.

Figure 7:
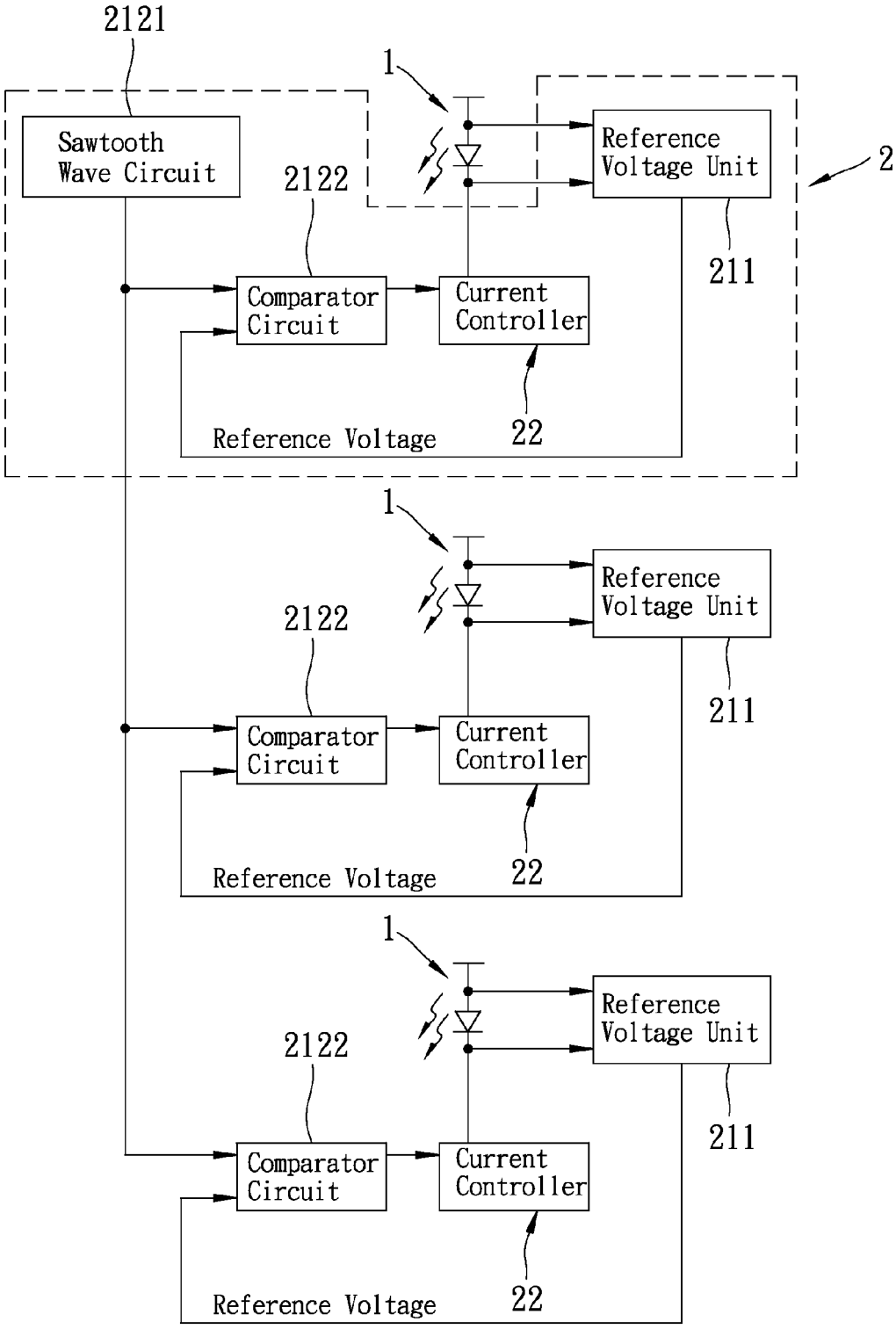
FIG. 7 is a block diagram of an application of the preferred embodiment.

Referring to FIG. 7, an application of the light emitting system is a light-mixing control system with high color rendering index, which includes three light emitting systems of the preferred embodiment that share one sawtooth wave circuit 2121 and that respectively include the light emitting devices 1 with different colors, such as red, blue and green.

The amplification of the power amplifier 2113 of each reference voltage unit 211 is determined as mentioned above, so that the optical power of the corresponding light emitting device 1 is non-varying with the ambient temperature, and the predetermined DC voltage of the level shifter 2114 of each reference voltage unit 211 is determined upon a visual function of the human eyes for the corresponding color, so as to maintain a desired color temperature and color rendering index.

To sum up, the aforementioned application using the optical power control device 2 according to this invention has the following advantages:

1. Temperature increment of the LED is relatively small. The LED is driven by the driving current, which is a pulse current, such that the light emitting device 1 emits light in an active duration and dissipates heat in an inactive duration, resulting in a relatively small temperature increment. For example, when the duty cycle is 0.1, the LED emits light for one-tenth of a cycle time, and dissipates heat for the other nine-tenths of the cycle time, so as to alleviate the first drawback mentioned hereinbefore.

2. The optical power of the light emitting device 1 is maintained to be stable. The optical power control device 2 detects and feeds back the forward voltage variation resulting from the ambient temperature variation, so that the duty cycle of the control signal is adjusted for enabling the light emitting device 1 to operate with stable optical power, and the second drawback mentioned hereinbefore is thus alleviated.

3. The color temperature and the color rendering index of the resulting mixed light is relatively stable. Since the corresponding duty cycles of the light emitting devices 1 with different colors are controlled by a respective one of the optical power control devices 2 with consideration of the individual characteristics of the light emitting devices 1, the optical power of each of the light emitting devices 1 is maintained independently, resulting in the relatively stable color temperature and color rendering index.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A light emitting system comprising:

a light emitting device that has a forward voltage with a magnitude dependent on an ambient parameter when driven with current; and an optical power control device including:

a control signal module including:

a reference voltage unit coupled to said light emitting device for detecting the forward voltage thereof, and outputting a reference voltage according to the forward voltage of said light emitting device; and a control signal generator coupled to said reference voltage unit for receiving the reference voltage, and operable to generate, according to the reference voltage, a control signal having a parameter associated with the reference voltage; and a current controller coupled to said light emitting device, and coupled to said control signal generator for receiving the control signal, said current controller being operable to permit flow of a driving current through said light emitting device, the driving current being associated with the parameter of the control signal, wherein:

said current controller is configured such that the driving current has an average magnitude proportional to the parameter of the control signal;

said reference voltage unit is configured such that the reference voltage has a magnitude associated with an average magnitude of the forward voltage;

said control signal generator is configured such that the parameter of the control signal is associated with the magnitude of the reference voltage;

the control signal is a pulse signal, and the parameter of the control signal is a duty cycle of the pulse signal, the driving current being a pulse current, the reference voltage being a direct-current (DC) voltage; and said reference voltage unit includes:

a forward voltage detector coupled to said light emitting device for detecting the forward voltage thereof, and operable to output a detection signal that is a pulse voltage, and that has a magnitude varying with the magnitude of the forward voltage of said light emitting device;

a voltage integrator coupled to said forward voltage detector for receiving the detection signal, and operable to integrate the detection signal for generating an integration signal that is a DC voltage signal;

a power amplifier coupled to said voltage integrator for receiving the integration signal, and operable to amplify the integration signal for generating an amplified integration signal; and a level shifter coupled to said power amplifier for receiving the amplified integration signal, and operable to shift a voltage level of the amplified integration signal according to a predetermined DC voltage, so as to generate the reference voltage.

2. The light emitting system as claimed in claim 1, wherein said light emitting device is a light emitting diode device that has the forward voltage, the ambient parameter on which the magnitude of the forward voltage is dependent being an ambient temperature.

3. The light emitting system as claimed in claim 1, wherein said forward voltage detector includes:

first, second and third operational amplifiers, each having a first input, a second input and an output;

a first resistor coupled between said second input and said output of said first operational amplifier;

a second resistor coupled between said second input and said output of said second operational amplifier;

a third resistor coupled between said second input and said output of said third operational amplifier;

a fourth resistor coupled between said second inputs of said first and second operational amplifiers;

a fifth resistor coupled between said output of said first operational amplifier and said second input of said third operational amplifier;

a sixth resistor coupled between said output of said second operational amplifier and said first input of said third operational amplifier; and a seventh resistor coupled between said first input of said third operational amplifier and a ground node;

wherein said first inputs of said first and second operational amplifiers are coupled to said light emitting device for receiving the forward voltage thereof, and said output of said third operational amplifier outputs the detection signal.

4. The light emitting system as claimed in claim 1, wherein said voltage integrator includes:

an operational amplifier having a grounded first input, a second input and an output;

a first resistor having a first terminal coupled to said forward voltage detector for receiving the detection signal, and a second terminal coupled to said second input of said operational amplifier;

a second resistor coupled between said second input and said output of said operational amplifier; and a capacitor coupled across said second resistor;

wherein said output of said operational amplifier outputs the integration signal.

5. The light emitting system as claimed in claim 1, wherein said power amplifier includes:

an operational amplifier having a grounded first input, a second input and an output;

a first resistor having a first terminal coupled to said voltage integrator for receiving the integration signal, and a second terminal coupled to said second input of said operational amplifier; and a second resistor coupled between said second input and said output of said operational amplifier;

wherein said output of said operational amplifier outputs the amplified integration signal.

6. The light emitting system as claimed in claim 1, wherein said level shifter is a voltage adder which adds the predetermined DC voltage to the amplified integration voltage to generate the reference voltage.

7. The light emitting system as claimed in claim 1, wherein said level shifter is a voltage subtractor which subtracts the predetermined DC voltage from the amplified integration voltage to generate the reference voltage.

8. The light emitting system as claimed in claim 1, wherein said control signal generator includes:

a sawtooth wave circuit for generating a sawtooth pulse signal; and a comparator circuit coupled to said sawtooth wave circuit for receiving the sawtooth pulse signal, and coupled to said reference voltage unit for receiving the reference voltage, said comparator circuit being operable to generate the control signal according to comparison of the reference voltage and the sawtooth pulse signal, such that the duty cycle of the control signal has an inverse relation to a magnitude of the reference voltage.

9. An optical power control device adapted for use with a light emitting device that has a forward voltage, said optical power control device comprising:

a control signal module including:

a reference voltage unit to be coupled to the light emitting device for detecting the forward voltage thereof, and outputting a reference voltage according to the forward voltage of the light emitting device; and a control signal generator coupled to said reference voltage unit for receiving the reference voltage, and operable to generate, according to the reference voltage, a control signal having a parameter associated with the reference voltage; and a current controller to be coupled to the light emitting device, and coupled to said control signal generator for receiving the control signal, said current controller being operable to permit flow of a driving current through the light emitting device, the driving current being associated with the parameter of the control signal, wherein:

said current controller is configured such that the driving current has an average magnitude proportional to the parameter of the control signal;

said reference voltage unit is configured such that the reference voltage has a magnitude associated with an average magnitude of the forward voltage;

said control signal generator is configured such that the parameter of the control signal is associated with the magnitude of the reference voltage;

the control signal is a pulse signal, and the parameter of the control signal is a duty cycle of the pulse signal, the driving current being a pulse current, the reference voltage being a direct-current (DC) voltage; and said reference voltage unit includes:

a forward voltage detector to be coupled to the light emitting device for detecting the forward voltage thereof, and operable to output a detection signal that is a pulse voltage, and that has a magnitude varying with the magnitude of the forward voltage of the light emitting device;

a voltage integrator coupled to said forward voltage detector for receiving the detection signal, and operable to integrate the detection signal for generating an integration signal that is a DC voltage signal;

a power amplifier coupled to said voltage integrator for receiving the integration signal, and operable to amplify the integration signal for generating an amplified integration signal; and a level shifter coupled to said power amplifier for receiving the amplified integration signal, and operable to shift a voltage level of the amplified integration signal according to a predetermined DC voltage, so as to generate the reference voltage.

10. The optical power control device as claimed in claim 9, wherein said forward voltage detector includes:

first, second and third operational amplifiers, each having a first input, a second input and an output;

a first resistor coupled between said second input and said output of said first operational amplifier;

a second resistor coupled between said second input and said output of said second operational amplifier;

a third resistor coupled between said second input and said output of said third operational amplifier;

a fourth resistor coupled between said second inputs of said first and second operational amplifiers;

a fifth resistor coupled between said output of said first operational amplifier and said second input of said third operational amplifier;

a sixth resistor coupled between said output of said second operational amplifier and said first input of said third operational amplifier; and a seventh resistor coupled between said first input of said third operational amplifier and a ground node;

wherein said first inputs of said first and second operational amplifiers are to be coupled to the light emitting device for receiving the forward voltage thereof, and said output of said third operational amplifier outputs the detection signal.

11. The optical power control device as claimed in claim 9, wherein said voltage integrator includes:

an operational amplifier having a grounded first input, a second input and an output;

a first resistor having a first terminal coupled to said forward voltage detector for receiving the detection signal, and a second terminal coupled to said second input of said operational amplifier;

a second resistor coupled between said second input and said output of said operational amplifier; and a capacitor coupled across said second resistor;

wherein said output of said operational amplifier outputs the integration signal.

12. A control signal module adapted for use with a current controller to control flow of a driving current through a light emitting device that has a forward voltage, said control signal module comprising:

a reference voltage unit to be coupled to the light emitting device for detecting the forward voltage thereof, and outputting a reference voltage according to the forward voltage of the light emitting device; and a control signal generator coupled to said reference voltage unit for receiving the reference voltage, and operable to generate, according to the reference voltage, a control signal having a parameter associated with the reference voltage, the control signal to be provided to the current controller, wherein:

said reference voltage unit is configured such that the reference voltage has a magnitude associated with an average magnitude of the forward voltage;

said control signal generator is configured such that the parameter of the control signal is associated with the magnitude of the reference voltage;

the control signal is a pulse signal, and the parameter of the control signal is a duty cycle of the pulse signal, the reference voltage being a direct-current (DC) voltage; and said reference voltage unit includes:

a forward voltage detector to be coupled to the light emitting device for detecting the forward voltage thereof, and operable to output a detection signal that is a pulse voltage, and that has a magnitude varying with the magnitude of the forward voltage of the light emitting device;

a voltage integrator coupled to said forward voltage detector for receiving the detection signal, and operable to integrate the detection signal for generating an integration signal that is a DC voltage signal;

a power amplifier coupled to said voltage integrator for receiving the integration signal, and operable to amplify the integration signal for generating an amplified integration signal; and a level shifter coupled to said power amplifier for receiving the amplified integration signal, and operable to shift a voltage level of the amplified integration signal according to a predetermined DC voltage, so as to generate the reference voltage.

* * * * *